US006428004B1

(12) United States Patent
McQuitty et al.

(10) Patent No.: US 6,428,004 B1
(45) Date of Patent: Aug. 6, 2002

(54) PREGNANCY AND CHILDBIRTH EDUCATIONAL BOARD GAME

(76) Inventors: LaNette J. McQuitty, 2821 S. Franklin Ct., New Berlin, WI (US) 53151; Aimee C. Siller, 7006 N. 44th St., Milwaukee, WI (US) 53223

( * ) Notice: Subject to any disclaimer, the term of this patent is extended or adjusted under 35 U.S.C. 154(b) by 0 days.

(21) Appl. No.: 09/613,678

(22) Filed: Jul. 11, 2000

Related U.S. Application Data

(60) Provisional application No. 60/149,233, filed on Aug. 17, 1999.

(51) Int. Cl.[7] ..... A63F 9/00

(52) U.S. Cl. ..... 273/249; 273/308; 273/302

(58) Field of Search ..... 273/236, 242, 273/243, 244.2, 248, 249, 258, 252, 308, 302

(56) References Cited

U.S. PATENT DOCUMENTS 1,635,734 A * 7/1927 Zigler
3,191,184 A * 6/1965 Durstewitz
4,440,396 A * 4/1984 Frudakis
5,071,133 A * 12/1991 Smith
5,071,134 A * 12/1991 Burroughs
5,152,535 A * 10/1992 Roberts
5,704,611 A * 1/1998 Pierce
5,758,877 A * 6/1998 Liddell
6,209,871 B1 * 4/2001 Butler

FOREIGN PATENT DOCUMENTS

GB 2254565 A * 10/1992

* cited by examiner

*Primary Examiner*—Benjamin H. Layno
*Assistant Examiner*—Vishu K Mendiratta
(74) *Attorney, Agent, or Firm*—Donald J. Ersler

(57) ABSTRACT

A pregnancy and childbirth education board game includes a game board, a plurality game pieces, and at least one set of playing cards. The game board includes a plurality of playing spaces. Preferably, there are two groups of playing spaces. The first group of playing spaces are formed around a periphery of the game board. The second group of playing spaces are disposed inside the first group. The at least one set of playing cards instruct players to move their game piece a set number of space(s) and player also reads information out loud on the playing card concerning pregnancy and childbirth. The first player to reach the last playing space wins the game.

7 Claims, 3 Drawing Sheets

PREGNANCY AND CHILDBIRTH EDUCATIONAL BOARD GAME

CROSS-REFERENCES TO RELATED APPLICATIONS

This is a utility patent application having priority from Provisional Application No. 60/149,233 filed on Aug. 17, 1999.

BACKGROUND OF THE INVENTION

1. Field of the Invention

The present invention relates generally to board games and more specifically to a pregnancy and childbirth board game which educates and entertains players about pregnancy, labor, and childbirth.

2. Discussion of the Prior Art

Currently it appears there is no board game which educates and entertains expectant parents, family members, friends, health care providers, and players about pregnancy, labor, and childbirth. It also appears that there is no board game which provides learning experiences and facilitates communication between expectant parents, family members, friends, health care provides and players about pregnancy, labor, and childbirth. It further appears that there exists no board game which helps improve the physical and emotional outcome of pregnancy, labor and childbirth.

Accordingly, there is a clearly felt need in the art for a pregnancy and childbirth educational board game which educates and entertains players about pregnancy, labor, and childbirth.

SUMMARY OF THE INVENTION

The present invention provides a pregnancy and childbirth educational board game which entertains as well as educates players about pregnancy, labor, and childbirth. The pregnancy and childbirth education board game includes a game board, a plurality of game pieces, and at least one set of playing cards. The game board includes a plurality of playing spaces. Preferably, there are two groups of playing spaces. The first group of playing spaces are preferably formed around a periphery of the game board. The second group of playing spaces are disposed inside the first group. The first group of playing spaces are preferably divided into three sets. The first set of playing spaces concern the first trimester of pregnancy. The second set of playing spaces concern the second trimester of pregnancy. The third set of playing spaces concern the third trimester of pregnancy.

Preferably, there are five sets of playing cards. The first set of playing cards are drawn from when a player lands in any one of the first trimester playing spaces. The second set of playing cards are drawn from when a player lands in any one of the second trimester playing spaces. The third set of playing cards are drawn from when a player lands in any one of the third trimester playing spaces. The fourth set of playing cards are drawn from when a player lands in one of the labor playing spaces. The first through fourth playing cards contain an instruction on how many spaces to move and educational information. A fifth set of cards describe the name of at least one baby and its weight.

Each player starts the game by picking up a first trimester playing card and moves their game piece according to the first trimester playing card. When the game piece moves into a second trimester playing space, the player draws from the set of second trimester playing cards. When the game piece moves into a third trimester playing space, the player draws from the set of third trimester playing cards. When the game piece moves into the labor playing spaces, the player draws from the labor playing cards. The first player who moves out of the labor space wins.

Accordingly, it is an object of the present invention to provide a pregnancy and childbirth educational board game which educates players about pregnancy, labor, and childbirth in an entertaining way.

It is a further object of the present invention to provide a pregnancy and childbirth educational board game which provides learning experiences and facilitates communication between players.

It is yet a further object of the present invention to provide a pregnancy and childbirth educational board game which helps improve the physical and emotional outcome of pregnancy, labor and childbirth.

Finally, it is another object of the present invention to provide a pregnancy and childbirth educational board game which is easy to play.

These and additional objects, advantages, features and benefits of the present invention will become apparent from the following specification.

DETAILED DESCRIPTION OF THE PREFERRED EMBODIMENTS

Figure 1:
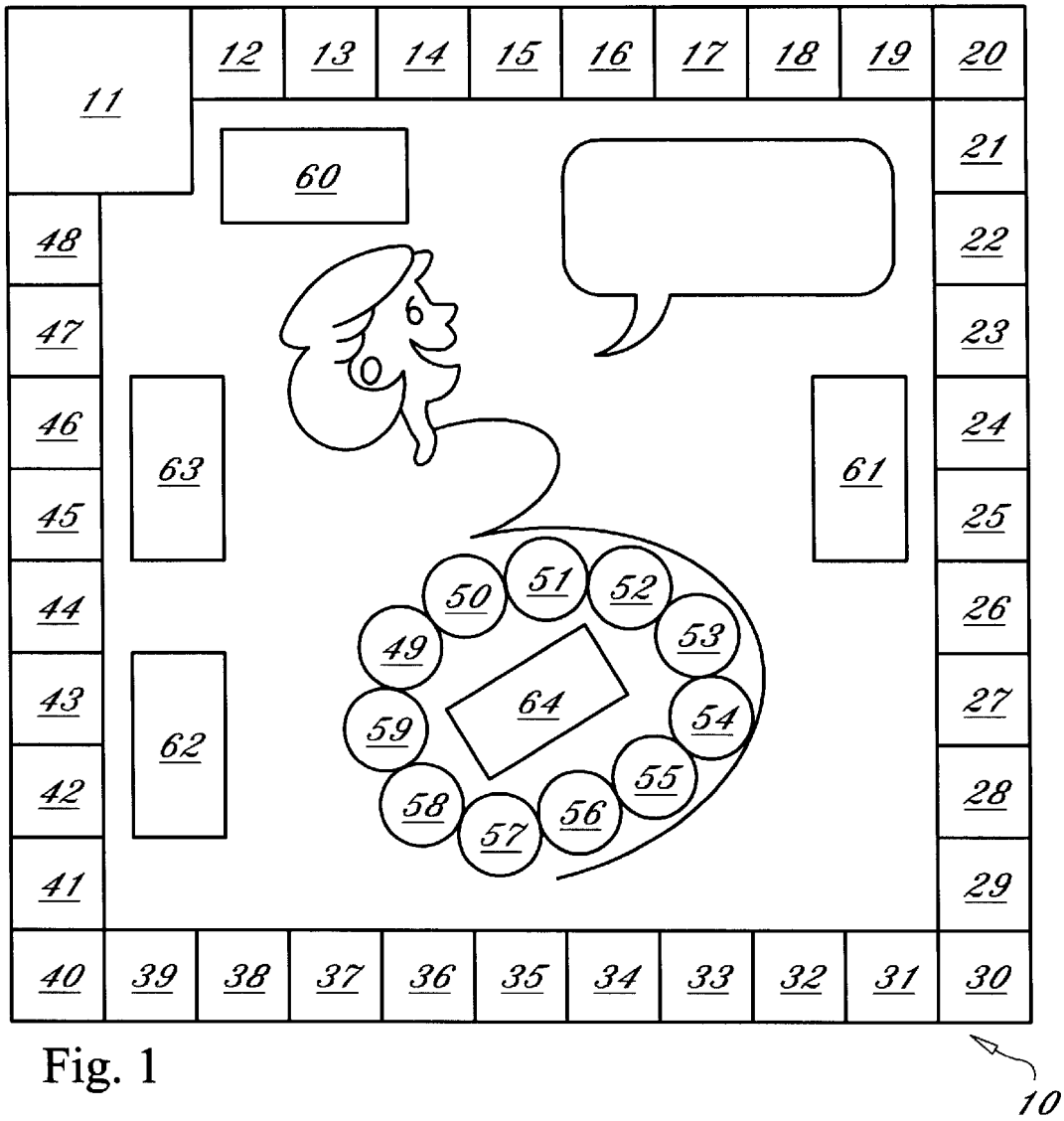
FIG. 1 is a top plan view of the game board of the pregnancy and childbirth educational board game in accordance with the present invention.
Figure 4:
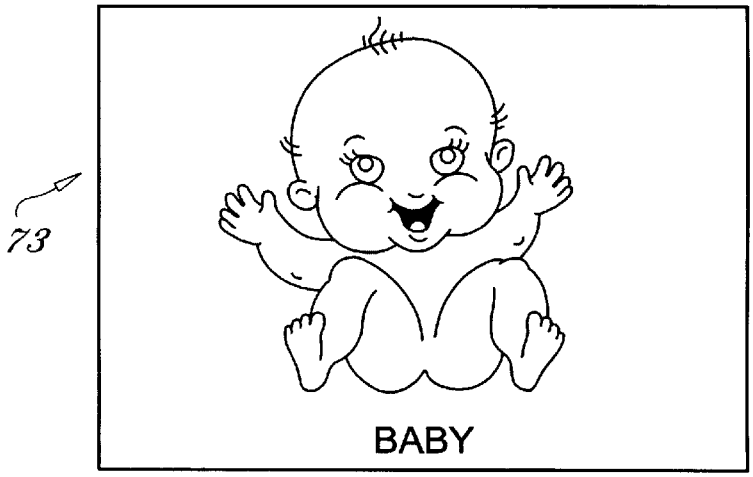
FIG. 4 is a front view of a baby playing card of the game board of the pregnancy and childbirth educational board game in accordance with the present invention.
Figure 2:
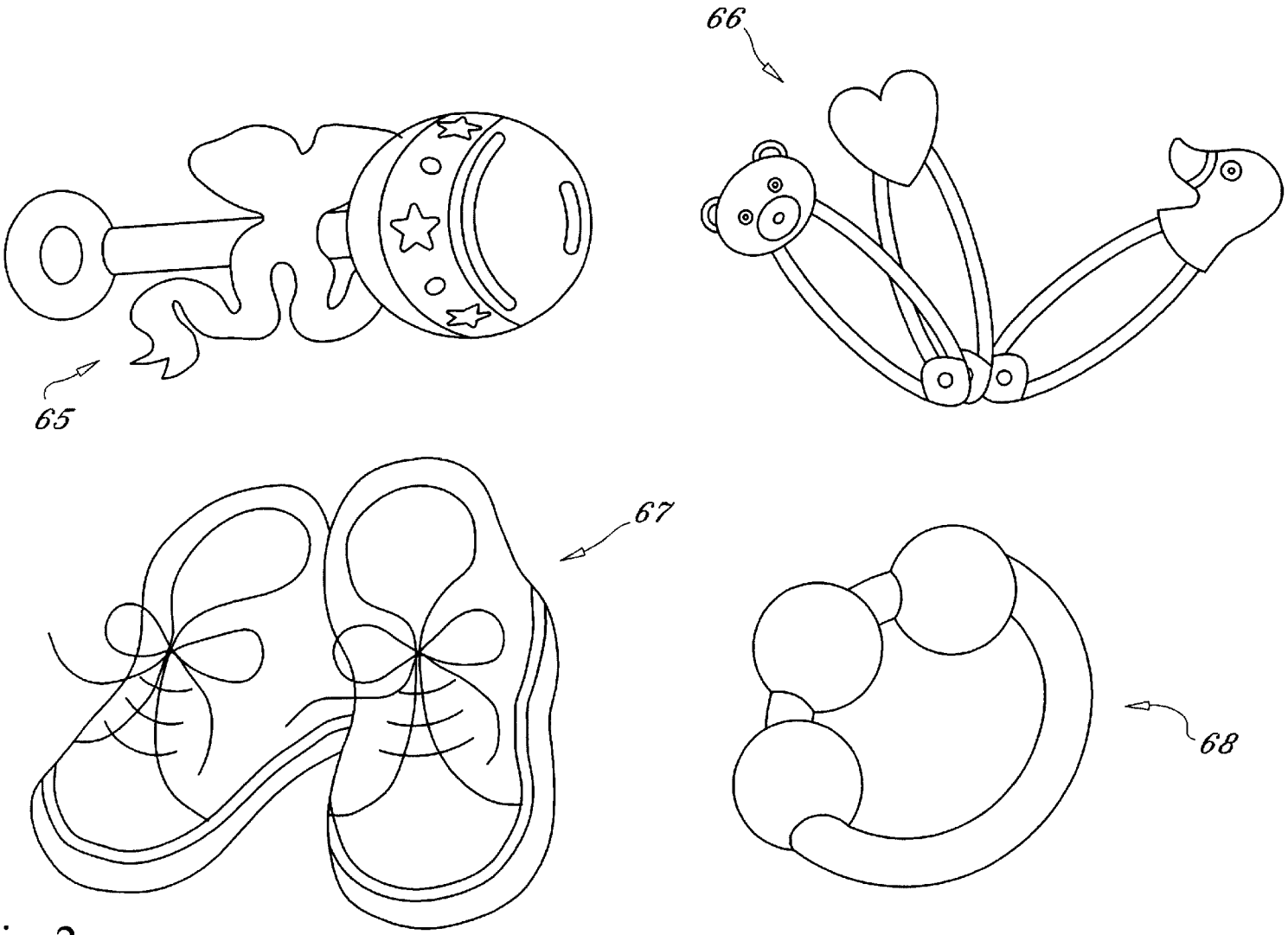
FIG. 2 is a perspective view of four preferable game pieces of the game board of the pregnancy and childbirth educational board game in accordance with the present invention.
Figure 3:
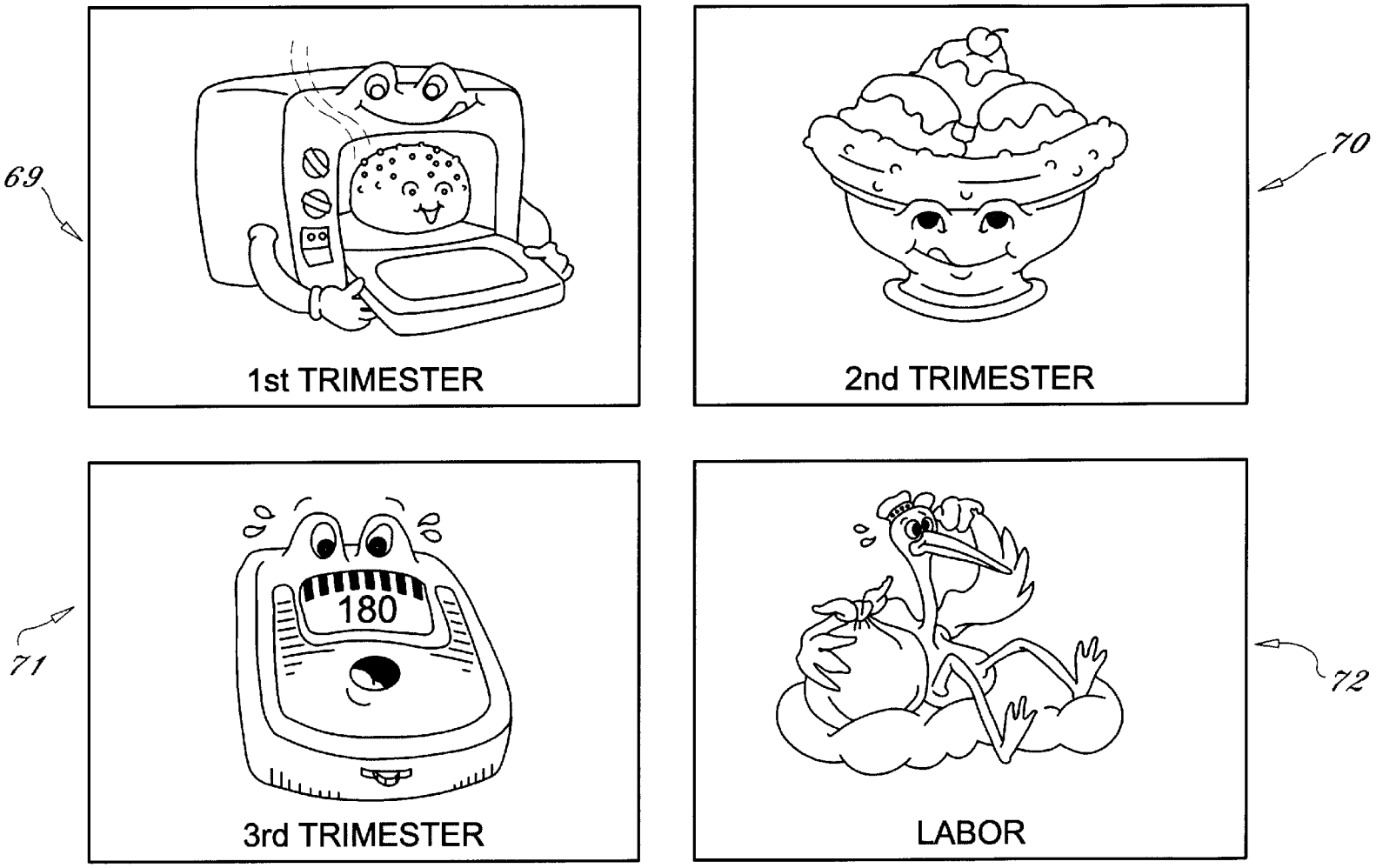
FIG. 3 is front view of four preferable sets of playing cards of the game board of the pregnancy and childbirth educational board game in accordance with the present invention.

With reference now to the drawings, and particularly to FIG. 1, there is shown a top view of a game board 10 of the pregnancy and childbirth educational board game. With reference to FIGS. 2–4, the pregnancy and childbirth educational board game includes the game board 10, a plurality game pieces, and at least one set of playing cards. The game board 10 includes a plurality of playing spaces. Preferably, there are two groups of playing spaces. The first group of playing spaces are preferably formed around a periphery of the game board and include playing spaces numbered 11–48. The second group of playing spaces are disposed inside the first group and include playing spaces numbered 50–57. Other game board layouts besides that described above could also be made.

The first group of playing spaces are preferably divided into three sets. The first set of playing spaces concern the first trimester of pregnancy and include playing spaces numbered 12–22. The playing space numbered 11 is where all players place their game pieces to start the game. The second set of playing spaces concern the second trimester of pregnancy and include playing spaces numbered 24–36. A playing space numbered 23 acts as a division between the first and second trimester playing spaces. The third set of playing spaces concern the third trimester of pregnancy and include playing spaces numbered 38–47. A playing space numbered 37 acts as a division between the second and third trimester playing spaces. Spaces 11, 23, and 37 may have an appropriate graphic image, such as a humanized bed. Playing spaces 12–22, 24–36, and 38–47 preferably have consecutive weeks of pregnancy printed thereupon, starting with week 4 and ending at week 39. Preferably, a physical fact about a baby's development is also printed in the playing space corresponding to that particular week.

Playing space 48 is preferably labeled "Start Labor." The fourth set of playing spaces concern labor and include playing spaces numbered 49–59. Playing spaces 50–59 are preferably consecutively printed with 1 CM through 10 CM to describe dilation during labor. Playing space 49 is preferably labeled "Start Labor."

Preferably, there are five sets of playing cards. The first set of playing cards 69 are drawn from when a player lands in any one of the first trimester playing spaces. Each first trimester playing card 69 preferably has a front as shown in FIG. 3. On the rear of the first trimester playing card 69 is an instruction on how many spaces to move and educational information about the first trimester of pregnancy. The second set of playing cards are drawn from when a player lands in any one of the second trimester playing spaces. Each second trimester playing card 70 preferably has a front as shown in FIG. 3. On the rear of the second trimester playing card 70 is an instruction on how many spaces to move and educational information about the second trimester of pregnancy.

The third set of playing cards 71 are drawn from when a player lands in any one of the third trimester playing spaces. Each third trimester playing card 71 preferably has a front as shown in FIG. 3. On the rear of the first trimester playing card 71 is an instruction on how many spaces to move and educational information about the third trimester of pregnancy. The fourth set of playing cards are drawn from when a player lands in one of the labor playing spaces. Each labor playing card 72 preferably has a front as shown in FIG. 3. On the rear of the labor playing card 72 is an instruction on how many spaces to move and educational information about labor. A fifth set of playing cards describe the name of at least one baby and its weight. The rear of the first through the fifth playing cards preferably have the information printed thereupon as described in tables I–V. The game board 10 preferably has spaces 60–63 reserved for the first through fourth sets of playing cards.

TABLE I

| First Trimester Cards |
|---|
| Mom & Dad decide to keep the pregnancy a secret . . . but while the in-laws are in town, the constant vomiting gives them away. * Most morning sickness will subside after the 1st trimester. Since this a normal sign of pregnancy MOVE AHEAD 2 WEEKS. |
| At the 1st prenatal visit, it was such internal exam, you could have had your molars checked at the same time. MOVE AHEAD 2 WEEKS for remaining pleasant. * This examination is sometimes referred to as a pelvic exam and includes the visual and manual check of the vagina, cervix and uterus. |
| Dad learns that even his smoking will affect the baby and he comes home with "the patch." MOVE AHEAD 3 WEEKS. * Second hand smoke contains over 40 toxic substances which cause cancer. |
| Mom breaks into a sprint in the department store when the cosmetics lady comes at her with a perfume bottle. MOVE AHEAD 1 WEEK. * Many women find they are more sensitive to smell during pregnancy. |
| Mom has gone 10 weeks without coffee. MOVE AHEAD 3 WEEKS. * Studies show that as little as 3 cups of caffeinated beverages a day may increase risk of miscarriage and growth retardation. |
| Between the exhaustion, vomiting and weight gain, Mom doesn't feel much like doing anything. But, she does take her mother's advice and starts a pregnancy journal. MOVE AHEAD 2 WEEKS. * Keeping a diary will help Mom to remember all of the details of this special time. |
| Dr. Jones seemed like the perfect OMB. until he have Mom & Dad the number to country club instead of his office. MOVE BACK 1 WEEK. * Choose your health care provider wisely. |
| In the last week, Mom has eaten more hot dogs than Vegies. Now she's swollen and can't get rid of this headache. GO BACK TO BED. * A low salt diet may help to reduce fluid retention. |
| Mom decided to skip breakfast so she could make it to her AM meeting, but she spent most of the meeting in the bathroom. MOVE BACK 1 WEEK. * Small frequent meals will help prevent nausea. |
| While Mom & Dad check over their insurance policy to see what is covered in the pregnancy, they discover that the insurance company will pay for a breastfeeding class! MOVE AHEAD 3 WEEKS. * Many insurance companies are recognizing the benefits of breastfeeding. Check your policy. |
| You notice Mom is looking at herself in the mirror a lot more lately. Tell her she is glowing and MOVE AHEAD 2 WEEKS. * Many women become more radiant during pregnancy due to hormonal changes and increased blood volume. |
| OK . . . so Mom feels a little paranoid calling her doctor about every over the counter medication . . . better safe than sorry! MOVE AHEAD 2 WEEKS. * While pregnant or nursing, Mom should call her health care provider about any medication. |
| As Mom is engrossed in a discussion, she begins to drool on her chin. MOVE AHEAD 1 WEEK. * Excessive saliva is common during pregnancy. |
| Mom schedules tours of the local hospitals, local birth center, and HOME. MOVE AHEAD 3 WEEKS. * Remember you can choose where you will give birth. |
| Although bleeding in the 1st trimester is not necessarily cause for alarm . . . better safe than sorry! Call your health care provider and GO BACK TO BED. * 1 out of every 4 women experience some bleeding in early pregnancy. |
| Dad is surprised when he comes home from the vet and the dog really wasn't the one with the gas! MOVE BACK 1 WEEK. * Progesterone suppresses bowel, causing gas. |
| Mom has read up on all prenatal testing to decide which ones are necessary to decide which ones are necessary for her and the baby. MOVE AHEAD 3 WEEKS. * NOT ALL testing done before the baby is born, is necessary in every pregnancy and expectant couple should be informed about all aspects of test before they participate. |
| Dad is enjoying the "view" of Mom's new bustling . . . unfortunately, they are too sore to touch! MOVE AHEAD 1 WEEK. * Breast tenderness is very common. |
| When Mom enters a public building, she first seeks out the location of the restores. MOVE AHEAD 1 WEEK. * Frequent urination is caused by the pressure of the growing baby on the bladder. |
| Mom has such gas, she could be "pull my finger" champion! Blame it on the fresh Vegies and MOVE AHEAD 2 WEEKS. * Dark green, leafy vegetables contain folic acid which prevents birth defects. |

TABLE I-continued

| First Trimester Cards |
|---|
| Dad was kind enough to pick up sparkling grape juice for New Year's Eve. MOVE AHEAD 2 WEEKS. * Alcohol has been linked to congenital malformations. |
| Friends and family learn not to take it personally when Mom falls asleep in the middle of a conversation. MOVE AHEAD 1 WEEK. * Women are often very fatigued during pregnancy. |
| Mom joined a prenatal exercise class. MOVE AHEAD 3 WEEKS. * Research has shown that 2nd stage labor is shorter for women who have exercised throughout their pregnancy. Specialized classes are available, which might include low impact aerobics, toning and stretching. |
| First of all, these prenatal vitamins are huge! On top of that, Mom is so nauseous, the sight of them makes her ill. MOVE AHEAD 1 WEEK. * Mom should try taking them before bed, so she can sleep through the nausea. |
| The 5th co-worker has told Mom how awful her birth experience was . . . this does not help Mom to prepare for birth. MOVE BACK 1 WEEK. * Women who feel active in decisions during labor have a more satisfying birth experience. |
| Mom is relieved to hear from the nutritionist that she will be able to continue her vegetarian diet. MOVE AHEAD 1 WEEK. * Good nutrition is essential to a healthy pregnancy. |
| Most people bring a list of questions to the prenatal visit. Dad brought a legal note pad, FULL! MOVE AHEAD 2 WEEKS. * Keeping a list of questions will help Mom & Dad be prepared for the next prenatal visit. |
| Mom had a great day today . . . until she saw the long distance commercial. Get the tissue and MOVE AHEAD 1 WEEK. * Mood swings are due to hormonal changes and are normal. |
| Dad is very relieved to learn that pregnancy after infertility is not an indicator of a high risk pregnancy. MOVE AHEAD 1 WEEK. * High risk pregnancy is defined as a pregnancy in which there is a greater risk of complication for Mom or Baby. |
| OK . . . so it's an old line, but Mom really does have a headache tonight. MOVE AHEAD 1 WEEK. * Due to increased hormones, many women experience headaches during pregnancy. |
| Mom is extremely irritable today. Dad says, "I thought you didn't get PMS when you you're pregnant." MOVE BACK 1 WEEK. * Mom's increased hormone levels and changing body may cause her to be more easily annoyed. |
| Mom realizes that it probably wasn't such a great idea to try to clean out a chicken . . . the constant nausea isn't helping. MOVE AHEAD 1 WEEK. * Research shows that 56% of all pregnant women experience some degree of nausea and vomiting. |
| Dad starts to pack the cat's things when Mom tells him about toxoplasmosis. What Mom is really trying to tell him is that he's changing the litter box for the next 9 months! MOVE AHEAD 2 WEEKS. * The parasite that causes this infectious disease is often found in cat feces. |
| If a double cheeseburger and chocolate malt are not in front of Mom in 5 minutes, someone will get hurt. MOVE AHEAD 1 WEEK. * Cravings are very commond during pregnancy. |
| Prenatal Visit: Lost 1 lb. MOVE AHEAD 1 WEEK. * Don't be concerned, the nausea will subside and your appetite will come back. |
| Sure your skin is looking a little rough, but I'm sure there's a glow somewhere under all that acne! * Acne is caused by the rapid changes in hormones. The usual systemic prescribed medications are not safe for the Baby. Check with your doctor and MOVE AHEAD 1 WEEK. |

TABLE I-continued

| First Trimester Cards |
|---|
| Although feeling a little dizzy or faint could be due to normal hormone changes in pregnancy, Mom decides she should take a few more breaks during the day AND have Dad wait on her. MOVE AHEAD 2 WEEKS. * Progesterone causes the blood vessel walls to soften and dilate causing dizziness. |
| So far, Mom is not exactly on target with those weight gain charts!! She's been exercising and eating right, so she's not concerned and remembers that every body is different. MOVE AHEAD 2 WEEKS. * The growing Baby requires an additional 200 calories per day. |
| It's hard enough for Mom to brush her teeth with all the nausea, but this bleeding gums thing is really too much! MOVE AHEAD 1 WEEK. * The body's production of progesterone causes gum tissues to soften which can lead to bleeding. |
| Dad takes Mom on a romantic weekend. When Mom gets to the room and sees the heart shaped hot tub, she hates to tell Dad she won't be able to enjoy it with him. MOVE AHEAD 1 WEEK. * Baby's development could be at risk if Mom's body temperature has been elevated beyond 102 degrees for several minutes. |
| The decision about when Mom will tell her Boss about the pregnancy was made by Grandma, when she sent Mom 2 dozen pink and blue balloons at work. MOVE BACK 1 WEEK. * The law protects pregnant women against job discrimination. |
| Grandma won't let Mom put away the dinner dishes, she thinks that if Mom raises her arms above her head, the umbilical cord will strangle the baby. MOVE BACK 1 WEEK. * Expectant couples will hear many myths and superstitions; when in doubt ask your health care provider. |
| Mom realizes her best friend at work might not have been as good at keeping secrets as she first thought. Every time Mom goes to the bathroom all of her coworkers are checking to see if she's OK. MOVE AHEAD 1 WEEK. * The excitement of a pregnancy can be difficult to contain. |
| The Clerk at the pharmacy assures Dad that he probably should not spend his money on another pregnancy test. 4 positive results means he should spend his money on diapers. MOVE AHEAD 1 WEEK. * Give yourself time to absorb this wonderful news! |
| Mom's size indicates the possiblity of a multiple pregnancy. Dad thought it was all the ice cream Mom was enjoying. MOVE AHEAD 1 WEEK. * There are many support groups for parenting multiples. One great resource is TWINS magazine. You can subscribe by calling 1-888-558-9476. |
| Maybe Mom has been milking the pregnancy a little too much. She has just found Dad sleeping on a pile of laundry. MOVE BACK 1 WEEK. * During pregnancy Mom may need a little help, however pregnancy is not an illness. |
| Dad has traded in the two-seater sports car for a top of the line minivan. MOVE AHEAD 3 WEEKS. * Many men are often surprised at their change in priorities once they are about to become a father. |
| Dad went to the cookie outlet store and purchased every last case of Mom's favorite cookie. Mom takes one look at the cookies and tosses hers! MOVE AHEAD 2 WEEKS. * Cravings can change as quickly as Mom's moods. |
| While Mom is having her teeth cleaned, she starts questioning the Dentist about the cost of her Baby's braces. The Dentist says, "Brush, floss, and we'll talk about that in 12 years." MOVE AHEAD 1 WEEK. * Good dental hygiene is important during pregnancy. Make sure Dentist is aware that you are pregnant. |
| Thousands of women go through pregnancy every day, but Mom feels like she is the first. MOVE AHEAD 1 WEEK. * Every woman will have her own special and unique experience. |

TABLE II

| Second Trimester Cards |
| --- |
| Dad understands Mom's reluctance to move into maternity clothing, but he's really had it with Mom stealing all of his underwear. MOVE AHEAD 1 WEEK. * Mom may need some time to become comfortable with her new shape. |
| Mom loves the new baby monitor she got as a gift from a friend. Especially when she overheard Dad in the Baby's room practicing nursery rhymes. MOVE AHEAD 2 WEEKS. * There are times when Parents need to be in another room, monitors will help keep them in touch with baby. |
| Even though Grandma & Grandpa don't understand the whole Cord Blood issue, they are impressed with the information Mom & Dad have learned on the subject. MOVE AHEAD 3 WEEKS. * Cryopreserving your Baby's umbilical cord blood stem cells at birth could provide a vital lifesaving medical benefit. |
| Mom has been so constipated, she's started a library in the bathroom. MOVE BACK 1 WEEK. * Increasing water intake may help to remedy constipation. |
| Baby can now hear noises . . . and the things Mom said to that truck driver today . . . MOVE BACK 1 WEEK. * By the 20th week Baby is anatomically developed enough to receive sound impulses. |
| Mom has finally convinced Dad that the Baby won't feel a thing, if they have a romantic evening. MOVE AHEAD 2 WEEKS. * Intimacy, including sexual intercourse, can continue to be satisfying throughout the entire pregnancy. |
| Due to Mom's expanding waist line, Grandma offers to take Mom to the nearest "Fashion After Passion" store. MOVE AHEAD 1 WEEK. * Pregnancy is not the time for dieting or weight loss. |
| Mom finds her local La Leche League group and goes to a meeting. MOVE AHEAD 3 WEEKS. * Educating yourself about breastfeeding before the Baby comes will increase your success. |
| During the next prenatal visit, Mom will have an ultrasound. Mom & Dad tell the in-laws that they could find out the gender. Grandpa says "That's like peeking at your Christmas presents!" MOVE AHEAD 1 WEEK. * Ultrasound is an image generated by sound waves and displayed on a monitor. |
| Dad is thinking, if Mom is screaming this loud for leg cramps in the middle of the night, he better bring ear plugs to the birth. MOVE AHEAD 1 WEEK. * Possible causes of leg cramps are: A shortage of calcium in the diet or an excess of phosphorus. Phosphorus is found in processed meats and sodas. |
| When Mom stubs her toe, Dad reminds her that this would be a good time to practice her breathing. She stomps on his foot and says- "you breathe." MOVE BACK 1 WEEK. * Practicing your relaxation techniques in advance, will help them become a more natural response to the challenges of labor. |
| Hemorrhoid commercials are very important now! MOVE AHEAD 1 WEEK. * Up to 50% of all pregnant women will experience swelling of the rectal veins which is caused by extra pressure on these veins. |
| There are not very many things as cute as fetal hiccups. MOVE AHEAD 2 WEEKS. * While the Baby is still in the uterus, ingesting amniotic fluid can cause hiccups. |
| NO . . . Dr. Spoke is not the guy with the pointy ears! MOVE BACK 1 WEEK. * Dr. Spock is one of many baby experts, but Mom & Dad know their baby best. |
| Mom has finally accepted her unstoppable hunger and is now carrying emergency snacks in her purse. MOVE AHEAD 2 WEEKS. * Eating every 3 to 4 hours will help maintain energy. |
| At this prenatal visit, Dad hears the hearbeat for the first time and realizes he's going to be responsible for a whole other person. MOVE AHEAD 1 WEEK. * There are many emotional moments during pregnancy that Mom and Dad may need to discuss. |

TABLE II-continued

| Second Trimester Cards |
| --- |
| Baby has been kicking all day long, except when Dad tries to feel it. MOVE AHEAD 1 WEEK. * The first fetal movements are usually felt between weeks 16 and 20, however these first movements may only be noticed by Mom. |
| Dad begins to talk about his concerns regarding providing for a baby. Mom listens and is reassuring. MOVE AHEAD 2 WEEKS. * Dad may experience moments of anxiety when thinking about his increasing responsibilities. |
| Mom's nails never looked so good! These prenatal vitamins are great! MOVE AHEAD 2 WEEKS. * Vitamins are never a substitute for a well balanced diet. |
| Maybe Mom should have let people help her with that huge family diner. Her feet are swollen and her back is sore. GO BACK TO BED. * Learning to ask for help now will make it easier when the Baby is here. |
| Whew! So many choices in Childbirth Education Classes . . . Just remember, find the one that's right for Mom & Dad! MOVE AHEAD 3 WEEKS. * If you don't know your options-you don't have any. |
| Trendy fashions for Mom, OUT . . . Great, big, roomy clothes, IN. MOVE AHEAD 1 WEEK. * Non-restrictive clothing will help Mom feel more comfortable. |
| The Doctor gets the hint that she has a cold exam room, when she finds Mom is wearing long underwear under her exam gown. MOVE AHEAD 1 WEEK. * Lower room temperatures may help to prevent the spread of germs. |
| Dad mentions to the Doctor that Mom is not able to "hold it" when she sneezes or laughs. OOPS, Not Enough KEGELS! MOVE BACK 1 WEEK. * Keels are performed by alternately contracting and relaxing the pelvic floor muscles, which include the areas surrounding the vaginal and rectal opening. |
| Now that Mom & Dad have heard advice about birth from everyone in a 100 mile radius, they decide to learn as much as they can about all of their options to be sure they have the experience they want. MOVE AHEAD 3 WEEKS. * There are more options available today than just the traditional hospital birth. |
| What are you looking at? Men scratch their bellies in public all the time. MOVE AHEAD 1 WEEK. * Stretching skin will often be dry and itchy. |
| While at Mom's company holiday party, Mom cleverly has Dad go up to the buffet to get her the 3rd helping of the night . . . no one will notice! MOVE AHEAD 1 WEEK. * Many women indulge their increased appetite during the 2nd trimester. |
| Although Mom & Dad have decided on a home birth, they preregister at a nearby hospital at the request of their midwife. MOVE AHEAD 2 WEEKS. * Home birth with an experienced midwife is a safe option, but families should be prepared if a problems arise. |
| Mom has started to tape Kathy Lee Gifford in the morning, just to hear all the cute stories about her kids! MOVE AHEAD 1 WEEK. * Soon, you too will be boasting about your Baby. |
| Prenatal Visit--Your blood pressure is eleveated. GO DIRECTLY TO BED. * Blood pressure should be monitored throughout the entire pregnancy to check for pregnancy induced hypertension. |
| Borrowing someone else's baby, seemed like a good idea at the time; but after 4 hour, 6 diapers and 500 yards of pacing . . . you decide to wait and learn with your own! MOVE BACK 1 WEEK. * Every baby is different, yours will be perfect. |
| Mom is trying to decide whether to return to work after the Baby is born. Dad is kind enough to point out all the extras he would be willing to give up! MOVE AHEAD 3 WEEKS. * The salary for a Stay-At-Home-Mom is not much but the benefits are great. |

TABLE II-continued

| Second Trimester Cards |
|---|
| Dad would not discuss home birth, until Mom mentions that Babe Ruth, Oprah Winfrey, Elton John and Elvis were all born at home. MOVE AHEAD 2 WEEKS. * ALL options should be discussed. |
| As Mom is quietly looking out the window, Dad asks what she is thinking about. How do you really explain a Kegel to a man? MOVE AHEAD 2 WEEKS. * The kegel exercise, is done by contracting and relaxing the pelvic floor muscles, and will condition the muscles used during birth. |
| Prenatal Visit--Mom has gained 8 lb. and blood pressure is great! MOVE AHEAD 1 WEEK. * Mom's healthy lifestyle combined with good prenatal care, benefits both Mom and Baby. |
| Dad is really trying to find a way to comfort Mom. What he can't figure out is which part of The Three Stooges movie was so sad?! MOVE AHEAD 2 WEEKS. * Feelings are never right or wrong, they just ARE. |
| Mom knows that she should be getting 60–80 grams of protein a day, but the ideal way to get them is probably not 3 fast food hamburgers per day. MOVE BACK 1 WEEK. * Protein provides material for growing tissues. |
| Mother-in-law was not trying to be funny when she suggested you name the Baby after Great Uncle Oracle. MOVE BACK 1 WEEK. * The name of every Person, Place or Thing will become a potential name for Baby. |
| While picking out wallpaper for the nursery, Mom & Dad can't seem agree. It's between ducks and bunnies and Ode to Bart Star. MOVE BACK 1 WEEK. * Parenting is a team effort that involves compromising all the way through. |
| The first "Baby" purchase . . . the car seat. Dad drops it before he even gets it in the car! He'll have to be a little more careful when there's a baby in there. MOVE BACK 1 WEEK. * Get familiar with the Baby's car seat, you will need it to bring home the Baby. |
| Mom wakes Dad up again at 3:00 am to yell at him for what he did in her dream! MOVE BACK 1 WEEK. * Many women experience vivid dream cycles during pregnancy. |
| On the way home from the grocery store, Mom eats the whole bag of chocolate chips she was going to use for her home make cookies. Now she's throwing up! MOVE BACK 1 WEEK. * Sometimes, too much of a good thing is NOT a good thing. |
| Dad wants to talk to the Baby in utero, so the Baby will recognize his voice once it's here; but does it have to be about the importance of frequent oil changes and regular auto maintenance? MOVE AHEAD 2 WEEKS. * Studies have shown, Baby can distinguish familiar voices by the 5th month. |
| One never realizes how wise their parents are until they are about to become one! MOVE AHEAD 1 WEEK. * Sharing the events of a pregnancy can bring families closer. |
| Dad and the 3rd shift convenience store guy are on a first name basis. MOVE AHEAD 2 WEEKS. * Nausea in the 1st trimester may have hindered Mom's cravings. In the 2nd trimester, nausea has subsided and cravings may catch Mom off guard. |
| Mom informs Dad that he will not be able to go to the driving range to practice his golf swing while she's in labor; just because they will be having a doula! MOVE AHEAD 3 WEEKS. * Studies have shown professional labor assistant can help mothers to go through labor more easily with less intervention. |
| Mom has been hinting to Dad that this would be the best time to travel. But when Dad starts to make plans for a fishing weekend, Mom takes matters into her own hands. MOVE AHEAD 1 WEEK. * The 2nd trimester is most comfortable for Mom and not too close to delivery. |
| Mom was laughing at "belly bras" . . . Now that she's feeling the aches and pains from stretching ligaments, she's thinking that it might not be such a bad investment. MOVE AHEAD 1 WEEK. * A device to support the muscles surrounding the uterus may alleviate some discomfort. |
| Mom is feeling great this week! She is so happy, she decides to sit down and write a letter to Baby. MOVE AHEAD 2 WEEKS. * What a treasure for Baby to know how loved it was before it was even born! |
| Dad realizes Mom is having a lot more trouble sleeping than he first suspected when he notices the daily deliveries from the "Late Night Shopping Network." MOVE AHEAD 1 WEEK. * Frequent trips to the bathroom and Mom's changing shape may make sleeping more difficult. |

TABLE III

| Third Trimester Cards |
|---|
| While standing in line at the grocery store, Mom quickly flips over all of the swimsuit issues! MOVE AHEAD 1 WEEK. * Remember . . . pregnant women are beautiful. |
| Mom accidentally pees all over her hand at her prenatal visit because she can't see the cup. MOVE AHEAD 1 WEEK. * Most prenatal visits will include a urine check for pH, Protein, Glucose and Keytone levels. |
| Remember . . . with every Braxton-Hicks contraction, your body is preparing for the miracle of birth. MOVE AHEAD 1 WEEK. * The irregularity of these practice contractions will confirm for Mom that they are Braxton-Hicks. |
| Mom is having a baby shower and Dad buys her the game Sequel: "Who's Raising this Baby Anyway." START LABOR. Mom now owns almost every book published on pregnancy! MOVE AHEAD 3 WEEKS. * Knowledge is POWER. |
| Mom has learned that keeping the seat belt under her growing Baby is the safest place. It's just finding under her growing belly that's so hard! MOVE AHEAD 2 WEEKS. * Developing Baby is a at greater risk of injury if Mom is unrestrained. |
| Hopefully you'll never need it, but what a great thing to do for your Baby. Mom & Dad are attending Infant/Child CPR classes. MOVE AHEAD 3 WEEKS. * CPR started by a bystander will double a victims chances for survival. To find a class in your area, contact WWW.REDCROSS.ORG or 1-800-883-3656. |
| Is that your belly button, or are you just happy to see me? MOVE AHEAD 1 WEEK. * Growing baby and uterus may cause Mom to have an "out." The protruding belly button usually occurs late in pregnancy. |
| Dad is losing his position in the bed, due to all of the pillows Mom is now sleeping with. MOVE AHEAD 1 WEEK. * The placement of pillows between Mom's legs, behind her back and under her belly may help her sleep more comfortably. |
| So, Mom has locked her keys in the car 3 times this month! She has "pregnancy brain." MOVE AHEAD 1 WEEK. * Between hormonal changes and preoccupation with the upcoming birth, Mom may find she's not always able to focus. |
| While packing Mom's suitcase for the hospital, she keeps in mind that she will still look pregnant when she leaves. Pout about it now, instead of later and MOVE AHEAD 1 WEEK. * Remember it took your body 9 months to get that way, it may take 1 year to get back. |
| Dad proudly announces the title of the birth video- "THE GREATEST SHOW ON BIRTH!" MOVE AHEAD 2 WEEKS. * Check the batteries in the camcorder & camera and pack them now. |

TABLE III-continued

Third Trimester Cards

The stuffy nose may not be comfortable but remember that Mom's body is producing hormones to soften the cervix, which may also cause mucus membranes in the nose to swell. MOVE AHEAD 1 WEEK. * The CURE for this is BIRTH!

The Baby has dropped . . . in order to pick up the underwear Dad left on the floor, Mom must spread her legs and imitate a giraffe! MOVE AHEAD 1 WEEK. * Baby will move down in the pelvis in preparation for birth. Remember to use proper bending and lifting techniques.

Mom's friends are kind enough to chip in for a prenatal massage. MOVE AHEAD 3 WEEKS. * Prenatal massage can improve circulation, reduce swelling and just feels great!

Dad comments on how Mom's belly looks like a road map of Southern California. MOVE AHEAD 1 WEEK. * Most women experience stretch marks to some degree.

I'm sure in some cultures a big, dark line down a woman's belly is very attractive! MOVE AHEAD 1 WEEK. * Linea Nigeria, which is a dark line extending from the navel to the top of the pubic area, is very common in the 3rd trimester.

Mom would like to avoid an episiotomy. Dad is thrilled that the preventative measure is nightly perennial massage. MOVE AHEAD 3 WEEKS. * An episiotomy is a surgical incision made in the perineum, which is the skin between the vagina and the rectum, to make room for the descending Baby.

On the way out of the prenatal visit, Dad decides to make a cute joke about Mom's weight gain . . . in front of the WHOLE waiting room! MOVE BACK 1 WEEK. * Remember, most weight gain information is based on the general population. Individual weight gain should be based on Mom's activity level and body composition.

Mom & Dad have registered for baby gifts at the local department store. Does Dad really think he's getting all of those power tools? MOVE AHEAD 1 WEEK. * Many stores have gift registries for expectant parents, you can even register online at WWW.BabyCenter.com.

Prenatal visit: Mom is telling her Doctor about reoccuring yeast infections. When the Doctor reminds her that refined sugar in the diet can be a cause, Dad starts to list Mom's treats this week; cookies, cupcakes, ice cream, that 1 lb. box of chocolate . . . MOVE BACK 1 WEEK. * Any vaginal itching or swelling should be reported to your health care provider.

Mom & Dad have begun the search for THE pediatrician. Even though grandma says he's the best . . . Mom & Dad can't see themselves taking their new Baby to Dr. Hatchet. MOVE AHEAD 1 WEEK. * An important thing to consider about Baby's pediatrician is that he/she has the same philosophies as Mom & Dad.

Dad mentions that this nesting thing is great! "Our house has never looked this good." MOVE AHEAD 1 WEEK. * Most women experience an natural, instinctual phase which includes intense cleanliness in preparation for birth.

Mom enters the 911 code on Dad's beeper, to test his response time. Unfortunately the price of the speeding ticket will prevent her from trying that again! MOVE BACK 1 WEEK. * An advanced plan of 24 hour communication will help Mom contact Dad when "it's time."

Mom runs to the store and when she returns, she finds 13 messages asking if she's had the Baby yet! MOVE AHEAD 1 WEEK. * Remember only 4% of babies are born on their due date.

When Dad comes back from lunch, there is a message on his voice mail from Mom. She has lost her mucus plug. Dad has called every hardware store in town trying to find a new one! MOVE AHEAD 1 WEEK. * When the cervix begins to change, a small mass of mucus is sometimes released.

Not only has Dad decided he will take advantage of family leave from work after the Baby is born, he has assured Mom he will take TABLE III-continued Third Trimester Cards care of her every need. MOVE AHEAD 3 WEEKS. * The Federal Family and Medical Leave Act "FMLA" provides the right to an unpaid leave of absence to up to 12 weeks to address family and medical responsibilities.

Mom's protruding belly has turned into a "stranger hand magnet!" MOVE AHEAD 1 WEEK. * Mom may feel as though her body has turned
into community property, however, most curiosity is combined with the knowledge that Mom is creating a miracle!

Mom realized how nice it was when she could take a deep breath. MOVE AHEAD 1 WEEK. * Due to growing Baby and uterus it is often harder for Mom to catch her breath.

After completing Childbirth Education Classes, Mom & Dad complete a BIRTH PLAN. MOVE AHEAD 3 WEEKS. * A written wish list, signed by Mom and her health care provider will help remind everyone what type of birth experience the expectant family would like.

Mom & Dad are both feeling a little disappointed as they leave the hospital. They were told it was only "false" labor. MOVE AHEAD 1 WEEK. * Actually it is Mom's body getting ready for labor. The cervix is becoming soft for dilation and effacement.

Mom is no longer searching for a bra with good "lift." Now she's more concerned with good "flaps." MOVE AHEAD 1 WEEK. * When purchasing a supportive bra, keep in mind that nursing bras with specially designed flaps make nursing more convenient.

Friends politely point out to Mom & Dad, that they may have gone a little overboard with the baby proofing of the house. There is now only a 6 ft square section that is not gated off and no one can figure out how to open the toilet. MOVE AHEAD 1 WEEK. * For a free brochure on childproofing call 1-888-8PUEBLO, ask for item 618F.

Dad doesn't understand why Mom is so angry that he has helped himself to all of the frozen meals she had in the freezer! MOVE BACK 1 WEEK. * Preparing meals in advance will allow you more time with Baby.

Mom finds herself folding those cute little baby clothes again and again and again . . . MOVE AHEAD 1 WEEK. * There is no need to purchase too many newborn clothes; your Baby's growth will amaze you.

Mom tries to hide the smashed picture of her Mother-in-law. Even though "clumsiness" is common, Grandma's not buying the story that Mom dropped the picture on accident! MOVE AHEAD 1 WEEK. * During pregnancy, a woman's center of gravity changes, causing clumsiness.

Mom is hysterical when she realizes she hasn't felt the Baby move all day. Dad calmly reminds her how busy she has been and gets her some juice to drink, while she lays down to count the Baby's movements. MOVE BACK 1 WEEK. * At the end of the 3rd trimester Mom should count fetal movements every day.

Dad is really making an effort to make Mom comfortable and brings her breakfast in bed. He can't stop laughing at the fact that Mom's belly no longer fits under the bed table. His laughter has just undone all of his good intentions. MOVE BACK 1 WEEK. * Sometimes what Mom needs most is someone to mother her.

Now who's idea was it to have 4 beef enchiladas before bed? MOVE BACK 1 WEEK. * Change in hormones can cause slower digestion, leading to heartburn.

Mom's least favorite co-worker is the first to notice that she could not see her shoes this morning to match them. MOVE BACK 1 WEEK. * Take a picture of Mom so she can recall just how big she really was.

While attending Childbirth Education Class, Dad passes out during the birth video. MOVE BACK 1 WEEK. * If Dad is feeling uncomfortable with the full responsibility of Mom's support, maybe TABLE III-continued

| Third Trimester Cards |
|---|
| they should consider a additional support person. |
| The ultrasound tech smiles at the eager parents and says "Could be a well endowed boy, could just be the umbilical cord!" MOVE BACK 1 BACK. * Ultrasound may be able to detect the Baby's gender, but is not always 100% accurate. |
| WADDLE? Of course, you're supposed to waddle! MOVE AHEAD 2 WEEKS. * Waddling is caused by your body's production of relaxin, the hormone that loosens the pelvis to help your Baby be born. Dad's explanation of his weight gain in Couvade. MOVE AHEAD 1 WEEK. * Some men experience sympathy symptoms such as nausea or weight gain. |
| Mom over did it by spending too much time at work this week. She is exhausted! GO BACK TO BED. * Mom's body is working hard. |
| So the pink moccasins don't match your busines suit! It is the only pair of shoes your swollen feet would fit in. GO BACK TO BED and put your feet up. * Elevating your feet during the day will help reduce swelling. |
| Mom is learning more about her body's physical responses to birth, like the brains release of endorphins, and she is growing more confident in her bodies ability to birth naturally. MOVE AHEAD 3 WEEKS. * Endorphins are released by the brain as a natural pain killer. |
| At Mom's prenatal visit, she finds out her baby is posterior. Mom goes home and works on pelvic rocking. MOVE AHEAD 2 WEEKS. * A posterior baby is positioned with it's back against Mom's back, causing back discomfort during labor. A hands and knees position with Mom arching and extending her back may encourage Baby to turn. |
| Mom has been chatting in a restaurant for an hour before she notices the big wet circles on the front of her shirt. MOVE AHEAD 1 WEEK. * Leaking of colostrum is normal in the 3rd trimester. |
| The Doctor explains that lightening is when the baby drops to prepare for the birth. What Mom wants to know is why lightening is so HEAVY on her bladder. MOVE AHEAD 1 WEEK. * Mom's that have given birth previously may not experience lightening until labor begins. |

TABLE IV

| Labor Cards |
|---|
| When the Doctor arrives and checks Mom, he says that her water really hasn't broken. Dad is wondering to himself; "Then what was that wet spot on my favorite recliner?" NO PROGRESSION Moms often misinterpret leaking urine for amniotic fluid. |
| As Mom is laboring at the hospital, a nurse comes in to give Mom an IV. Dad politely pulls out the birth plan, signed by their midwife, stating they did not want an IV. PROGRESS 2 CM. * The birth plan will inform the staff of the birthing family's wishes regarding routine procedures. |
| When the nurse appears with the bed pan, Mom decides she is up to taking that walk to the toilet. PROGRESS 1 CM * An empty bladder may help labor to progress more smoothly. |
| Mom screams - "Get out of here." Dad knows that this could be transition and this is definitely not the time to leave. PROGRESS 1 CM. * Transition is the phase of labor when Mom dilates from 7 to 10 centimeters. This phase requires extreme concentration and loving support. |
| Between contractions, Mom & Dad are still thumbing through the baby name book! NO PROGRESSION. * Most women find they have no discomfort between contractions during early labor. |
| When the nurse comes in to set up the stirrups, Dad says "I think |

TABLE IV-continued

| Labor Cards |
|---|
| we'll try this bare back for a while." PROGRESS 1 CM. * The use of stirrups during pushing increases the need for episiotomy and does not help Mom utilize gravity for pushing. |
| As Mom begins another contraction, her support person notices she's breathing rapidly and very shallow. Her support person makes eye contact and takes long, deep breaths with her. PROGRESS 1 CM. * Visual demonstration are much more effective than verbal instructions. |
| Got Milk? No . . . Got Ice Chips! PROGRESS 1 CM. * Ice chips will help keep Mom hydrated. Mom mentions how uncomfortable she is on her back. |
| Dad reminds her that she can labor and deliver in any position she finds comfortable. She decides to squat and gravity moves the Baby right along! PROGRESS 4 CM. * Prior to labor, Mom & Dad should experiment with labor positions so that Dad will know how to support Mom. |
| Dad is really tempted to turn on the game, just to check the score. He remembers that a lot of noise in the room will be a distraction for Mom . . . then he thinks about checking the score in someone else's room! NO PROGRESSION. * Distractions in the room will hinder Mom's concentration. |
| Mom decides to relieve some of the pain of labor by taking a shower, and Dad will go with her . . . then he stars singing "Having My Baby"---off key. PROGRESS 1 CM. * The shower's rhythmic stimulation on the back causes the brain to release endorphins, which are natural pain killers. |
| Mom begins to lose her bearing, tense up and scream. Her support person gently reminds her that things will progress better if she is not tense. NO PROGRESSION. * Relaxed muscles work more efficiently. |
| Dad is now making phone calls to let everyone know Mom is in labor . . . he realizes he's grabbed the wrong phone list after hanging up with the 5th guy from his softball team! NO PROGRESSION. * Even the most familiar number may escape your mind during this exciting time. |
| Mom changes her mind . . . How can she have the baby today? She couldn't reach her legs to shave them this morning. NO PROGRESSION. * Letting go of mental inhibitions will allow Mom's body to do it's physical work. |
| Mom catches a glimpse of herself in the "pushing mirror" and thinks . . . "That can't be what I look like . . . that must be a fun house mirror" NO PROGRESSION. * Mirrors should be available to enable Mom to view the Miracle of her labor. |
| Dad reminds Mom to relax between contractions and not anticipate the next one. PROGRESS 2 CM. * Relaxation is Mom's reward for completing another contraction. Celebrate each step as your labor of love. |
| Mom is having a hard time focusing and Dad tells her that soon she will be holding her baby. PROGRESS 1 CM. * Mom's surroundings will affect her progression. A quiet, peaceful atmosphere will help Mom to focus inward. |
| Mom is in very good spirits, when suddenly she stops laughing and begins to vomit. Her support person remembers to tell her--this is a good sign! PROGRESS 3 CM. * Sudden changes in Mom's expressions could be an indicator that labor is progressing quickly. |

TABLE IV-continued

| Labor Cards |
|---|
| When Mother-in-law comes in the room during labor, Dad whispers how nice it would be if she held Mom's hand . . . so he can put some of those ice chips on his broken fingers! PROGRESS 1 CM. * It may benefit Mom to have additional labor support. |
| After a few hours of not progressing "quickly"; Dad remembers that changing position may help. Dad helps Mom get on her hands and knees. PROGRESS 2 CM. * The process of Mom finding the most comfortable position will also help Baby descend. |
| Labor is picking up and Mom is having to concentrate on each contraction. Her support person remembers the music she picked out and turns it on for Mom. PROGRESS 1 CM. * Prior to labor, Mom should decide what things make her surroundings most comfortable. |
| Mom is having terrible back pain during labor, Dad remembers that the worst position for this, is Mom on her back. He helps Mom to change to a side lying position, which takes the pressure off her back. PROGRESS 1 CM. * Mom should be encouraged to change positions every 20 minutes. |
| Mom's water has broken and her health car provider finds a prolapsed cord. Mom must have a Cesarean Section. DELIVER THE BABY. * When a loop of cord emerges before the Baby, a surgical procedure opening the uterus is performed to deliver the Baby. |
| Expect Mom to be just as loud "cheering" on the birth of her Baby as Dad is when he is cheering on The Packers during the Super Bowl! PROGRESS 1 CM. * Although Mom may be unaware of how vocal she is, this may help in the progression of labor. |
| The Midwife lets Mom & Dad know that Mom is not fully dilated yet . . . even though Mom is really feeling like pushing. Dad remind Mom to raise her chin and pant. She's almost there . . . PROGRESS 3 CM. * Pushing before full dilation could cause the cervix to swell, slowing birth. |
| Dad is trying so hard to help Mom with her back labor by applying counter pressure to her back. He realizes he may be pushing a bit too hard when Mom begins to slip off the bed! NO PROGRESSION. * Applying pressure to the small of the back may help relieve some discomfort. |
| When the Doula arrives at the hospital, Mom & Dad are discouraged by how long labor has been taking. The Doula covers ALL the clocks and reminds Mom & Dad that the Baby will come! PROGRESS 1 CM. * Time should not be a measure of a labor, a satisfying experience is most important. |
| The only way Dad could convince Mom to take walk, was to give her cash and escort her to the hospital gift shop. PROGRESS 1 CM. * The upright position of walking allows gravity to work for Mom. |
| The Doctor had informed patients before, but he is blown by Dad's reason for not wanting an episiotomy. Dad explains the natural occurrence of fetal Heimlich. PROGRESS 2 CM. * After the Baby's head is born, and uncut vagina will contract on Baby's abdomen, forcing mucus and fluid from Baby's lungs. |
| During an internal exam, the Midwife exclaims that the Baby is at a +2 station. Dad is wondering which train station the Baby gets off at? NO PROGRESSION. * Station, indicates the degree of advancement of the Baby's presenting part through the pelvis. |

The game is started by placing the game pieces in playing space 11. A pregnant woman goes first. The order of the remaining players goes according to a clockwise rotation. A baby playing card is drawn from the fifth set of playing cards and placed rear down in a baby card space 64. Each player will draw a first trimester playing card to determine the movement of their game piece and read the information concerning the first trimester of pregnancy out loud. If a first trimester playing card instructs the player to go back to bed, the player places their game piece in playing space 11.

When a player's game piece moves into a second trimester playing space, the player draws from the set of second trimester playing cards. The second trimester playing card instructs the player to move their game piece a set number of space(s) and to read out loud information concerning the second trimester of pregnancy. If a second trimester playing card instructs the player to go back to bed, the player places their game piece in playing space 23.

When a player's game piece moves into a third trimester playing space, the player draws from the set of third trimester playing cards. The third trimester playing card instructs the player to move their game piece a set number of space(s) and to read out loud information concerning the third trimester of pregnancy. If a third trimester playing card instructs the player to go back to bed, the player places their game piece in playing space 37.

When the game piece moves into the playing space 48, the player's game piece is moved into playing space 49. When the player's next turn comes up, the player draws from the labor playing cards. The labor playing card instructs the player to move their game piece a set number of space(s) and to read out loud information concerning labor. The first person to make it to playing space 59 or to obtain the card which states "Deliver Baby" wins the game. The winner turns over the baby playing card to "receive their baby."

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A method of playing a game which allows players to be educated about pregnancy and childbirth, comprising the steps of:

(a) providing a plurality of game pieces;

(b) providing a game board which includes a plurality of first trimester spaces, a plurality of second trimester spaces, a plurality of third trimester spaces, and a plurality of labor spaces;

(c) providing a set of first trimester cards, each said first trimester card including an instruction about how many spaces to move one of said game pieces in said plurality of first trimester spaces and information concerning the first trimester of pregnancy;

(d) providing a set of second trimester cards, each said second trimester card including an instruction about how many spaces to move one of said game pieces in said plurality of second trimester spaces and information concerning the second trimester of pregnancy;

(e) providing a set of third trimester cards, each said third trimester card including an instruction about how many spaces to move one of said game pieces in said third trimester spaces and information concerning the third trimester of pregnancy;

(f) providing a set of labor cards, each said labor card including an instruction about how many spaces to move one of said game pieces in said plurality of labor spaces and information concerning labor;

(g) providing each said space with a further stage of fetal development;

(h) providing at least one card in each said set of trimester cards which instructs the player to go back to a beginning of that particular plurality of trimester spaces;

(i) choosing a card from at least one set of cards;

(j) reading information concerning the pregnancy process from said card chosen from said at least one set of cards; and (k) moving one of said game piece along said plurality of spaces as instructed by said card chosen from said at least one set of cards.

2. The method of playing a game which allows players to be educated about pregnancy and childbirth of claim 1, further comprising:

a set of baby playing cards, each one of said baby playing cards providing a name of at least one baby and its weight.

3. A method of playing a game which allows players to be educated about pregnancy, comprising the steps of:

(a) providing a plurality of game pieces;

(b) providing a game board which includes a plurality of first trimester spaces, a plurality of second trimester spaces, and a plurality of third trimester spaces;

(c) providing a set of first trimester cards, each said first trimester card including an instruction about how many spaces to move one of said game pieces in said plurality of first trimester spaces and information concerning the first trimester of pregnancy;

(d) providing a set of second trimester cards, each said second trimester card including an instruction about how many spaces to move one of said game pieces in said plurality of second trimester spaces and information concerning the second trimester of pregnancy;

(e) providing a set of third trimester cards, each said third trimester card including an instruction about how many spaces to move one of said game pieces in said third trimester spaces and information concerning the third trimester of pregnancy;

(f) providing at least one card in each said set of trimester cards which instructs the player to go back to a beginning of that particular plurality of trimester spaces;

(g) choosing a card from at least one set of cards;

(h) reading information concerning the pregnancy process from said card chosen from said at least one set of cards; and (i) moving one of said game pieces along said plurality of spaces as instructed by said card chosen from said at least one set of cards.

4. The method of playing a game which allows players to be educated about pregnancy of claim 3, further comprising the steps of:

(j) providing a game board which includes a plurality of labor spaces.

5. The method of playing a game which allows players to be educated about pregnancy of claim 4, further comprising the steps of:

(j) providing a set of labor cards, each said labor card including an instruction about how many spaces to move one of said game pieces in said plurality of labor spaces and information concerning labor during pregnancy.

6. The method of playing a game which allows players to be educated about pregnancy of claim 3, further comprising:

a set of baby playing cards, each one of said baby playing cards providing a name of at least one baby and its weight.

7. The method of playing a game which allows players to be educated about pregnancy of claim 3, further comprising:

(j) providing each said space with a further stage of fetal development.

* * * * *